US011465304B2

(12) United States Patent
Zandsteeg et al.

(10) Patent No.: US 11,465,304 B2
(45) Date of Patent: Oct. 11, 2022

(54) SYSTEM AND METHOD FOR AUTOMATED HAIRSTYLE PROCESSING AND HAIR CUTTING DEVICE

(71) Applicant: KONINKLIJKE PHILIPS N.V., Eindhoven (NL)

(72) Inventors: Cornelis Johannes Zandsteeg, Eindhoven (NL); Raymon Henk Uit De Bulten, Eindhoven (NL); Lolke Klaas Salverda, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 17 days.

(21) Appl. No.: 16/080,129

(22) PCT Filed: Feb. 28, 2017

(86) PCT No.: PCT/EP2017/054635

§ 371 (c)(1),
(2) Date: Aug. 27, 2018

(87) PCT Pub. No.: WO2017/148941

PCT Pub. Date: Sep. 8, 2017

(65) Prior Publication Data

US 2019/0047162 A1 Feb. 14, 2019

(30) Foreign Application Priority Data

Mar. 1, 2016 (EP) ..... 16158018

(51) Int. Cl.
*B26B 19/38* (2006.01)
*A45D 7/00* (2006.01)

(52) U.S. Cl.
CPC ..... *B26B 19/388* (2013.01); *A45D 2007/007* (2013.01)

(58) Field of Classification Search
CPC ..... B26B 19/388; A45D 2007/007
See application file for complete search history.

(56) References Cited

U.S. PATENT DOCUMENTS 3,413,985 A * 12/1968 Dlouhy ..... B26B 19/00 132/213
4,602,542 A * 7/1986 Natrasevschi ..... B26B 19/00 132/214

(Continued)

FOREIGN PATENT DOCUMENTS

JP 2005312920 11/2005
JP 2011022939 2/2011

(Continued)

OTHER PUBLICATIONS

Affidavit from Examiner Ken Peterson, prior to 2016.*

*Primary Examiner* — Kenneth E Peterson

(57) ABSTRACT

An automated hairstyle processing method, an automated hairstyle processing system, and an automated hair cutting device, the system including a memory unit arranged to store a predefined hairstyle model including hair property representing values and body shape representing values, a sampling unit arranged to sample an actual body shape, of a to be treated subject, involving detecting deviations from a model body shape portion of the predefined hairstyle model, a processing unit arranged to adapt a hair property model of the predefined hairstyle model, when deviations between the actual body shape and the model body shape portion are detected, so as to compensate the actual body shape deviations, the adaptions to the hair property model being local adaptations.

18 Claims, 6 Drawing Sheets

(56) References Cited

U.S. PATENT DOCUMENTS

| | | | | |
|---|---|---|---|---|
| 6,842,172 | B2 | 1/2005 | Kobayashi | |
| 6,994,552 | B2 | 2/2006 | Hirata | |
| 10,052,026 | B1 * | 8/2018 | Tran | A61B 5/742 |
| 10,339,706 | B2 * | 7/2019 | Black | G06Q 30/0601 |
| 2001/0026272 | A1 * | 10/2001 | Feld | G06T 17/00 345/419 |
| 2004/0049309 | A1 * | 3/2004 | Gardner | G06T 17/00 700/132 |
| 2004/0226424 | A1 * | 11/2004 | O'Banion | B27B 5/32 83/397 |
| 2004/0227752 | A1 * | 11/2004 | McCartha | A41H 3/007 345/419 |
| 2010/0070384 | A1 * | 3/2010 | Kruusmaa | G06Q 30/0601 705/26.1 |
| 2012/0086783 | A1 * | 4/2012 | Sareen | G06T 19/00 348/47 |
| 2013/0215116 | A1 * | 8/2013 | Siddique | G06Q 20/204 345/420 |
| 2014/0200734 | A1 | 7/2014 | Krenik | |
| 2015/0197016 | A1 * | 7/2015 | Krenik | B26B 19/388 83/13 |
| 2015/0217465 | A1 | 8/2015 | Krenik | |
| 2016/0247017 | A1 * | 8/2016 | Sareen | G06T 19/00 |
| 2017/0053422 | A1 * | 2/2017 | Chojnowski | H04N 13/189 |
| 2017/0061683 | A1 * | 3/2017 | Dorin | G06T 7/62 |
| 2017/0245570 | A1 * | 8/2017 | Yuen | A42C 3/06 |
| 2020/0382480 | A1 * | 12/2020 | Isaacson | G06Q 20/12 |
| 2021/0049811 | A1 * | 2/2021 | Fedyukov | G06T 7/50 |

FOREIGN PATENT DOCUMENTS

| | | | | |
|---|---|---|---|---|
| JP | 2013111274 | | 6/2013 | |
| JP | 2015136497 | | 7/2015 | |
| WO | WO0201984 | * | 1/2002 | A45D 44/00 |
| WO | 2013096572 | A1 | 6/2013 | |
| WO | 2013163999 | A1 | 11/2013 | |
| WO | 2015067634 | A1 | 5/2015 | |
| WO | WO2016012584 | * | 1/2016 | A61B 18/20 |
| WO | WO2017/060465 | * | 4/2017 | A45D 44/02 |

* cited by examiner

SYSTEM AND METHOD FOR AUTOMATED HAIRSTYLE PROCESSING AND HAIR CUTTING DEVICE

This application is the U.S. National Phase application under 35 U.S.C. § 371 of International Application No. PCT/EP2017/054635, filed on Feb. 28, 2017, which claims the benefit of International Application No. 16158018.8 filed on Mar. 1, 2016. These applications are hereby incorporated by reference herein.

FIELD OF THE INVENTION

The present invention relates to a method of automated hairstyle processing and to a system for automated hairstyle processing. The disclosure further relates to a hair cutting device that may form part of the system. The disclosure further relates to a corresponding computer program.

As used herein, automated hairstyle processing particularly relates to an approach that involves processing, particularly cutting, a subject's hair with an appliance that is capable of automatically adjusting a least one operation parameter, particularly a cutting length, depending on or as a function of an actual location of the appliance with respect to the individual subject. Automated hairstyle processing may be also referred to as automatic, semi-automatic or smart hairstyle processing.

The term automated hairstyle processing does not necessarily exclude any human/manual contribution or intervention. For instance, hand-held and hand-guided hair cutting devices may be used which implement an automated adjustment of an actual cutting length. Hence, automated hairstyling within the context of the present disclosure may also be referred to as computer-aided or computer-assisted smart hairstyling.

BACKGROUND OF THE INVENTION

WO 2013/163999 A1 discloses a programmable hair trimming system comprising a hair trimming device, said hair trimming system being arranged to detect, by means of an electromagnetic tracking system, the position of the hair trimming device in relation to the head of a person on whom a hair trimming operation is being performed; relate said position to previously generated hair length profile data regarding the desired hair trimming length at various positions; automatically and dynamically adjust the hair trimming length of said hair trimming device according to its present position and the hair length profile data. Further reference in this context is made to WO 2013/096572 A1 which discloses an automated system for cutting hair on a subject to conform to a specified style, the system comprising a hair cutting device configured to engage a cutting mechanism to cut said hair on said subject; and a positioning structure operable to interact with said hair cutting device to determine a position of said hair cutting device relative to a reference point.

US2014/200734 A1 discloses a method for assigning coordinate locations to positioning interfaces on a positioning device, said positioning device comprising a plurality of positioning interfaces and a structure at least partially extending in front of and to either side of the face of a user wearing said positioning device, so that changes to the locations of said positioning interfaces associated with said positioning device being worn by said user are at least partially accounted for, the method comprising directing said user to adjust said positioning device so that said positioning device is aligned with at least one of said user's eyes and nose; measuring at least one dimension between at least two points on said structure of said positioning device, said two points selected such that the dimension between them may vary depending on the size or shape of the head of a user wearing said positioning device; associating a coordinate system to said positioning device; and determining coordinate values for at least one of said positioning interfaces at least partially based on said at least one dimension between at least two points on said structure of said positioning device.

US2015/0217465 A1 discloses a user interface for use with automated hair cutting systems. The user interface allows the user to adapt a selected hairstyle to take into account the user's hair thickness, hair orientation, hair length, hair stiffness, hair curliness and hair care habits such as combing patterns.

Hair cutting and hairstyling are, to a great extent, manual tasks which typically require a skilled operator (hair stylist, hair dresser, etc.) who performs a haircut and/or hairstyling operation at a client. Generally, even if the client is satisfied with a particular haircut or hairstyle, the manual task needs to be performed repeatedly, for instance every four to eight weeks for relatively short haircuts. Further, even a well-experienced hairdresser or hairstylist cannot always exactly reproduce a certain haircut. The hairdresser may, on the one hand, imagine the to-be-applied haircut based on the current (grown) state of the hair. On the other hand, the hairdresser may recall and visualize the originally processed state of the previously performed haircut. Further, a client may choose and request a certain haircut by pointing at a visual representation of his/her own or other people wearing a model haircut.

Several attempts have been made to provide smart hair cutting appliances which allow a user to cut his/her hair or the hair of another person in a machine supported and controlled fashion. To this end, a hair cutting appliance may be provided which is arranged to adjust a present cutting length dependent on a certain position at the head of the to-be-treated person. In other words, the desired haircut is stored in a computing device which is arranged to operate the hair cutting appliance accordingly, for instance by adjusting a movable spacing comb. However, this basically requires that the model of the haircut is already stored in the computing device.

A data representation of a model haircut/hairstyle involves for instance a head topology map and a corresponding hair topology map. A head topology map may involve a three-dimensional representation of the (haired) head portion. A hair topology map may involve a corresponding length representation of the hair at the head portion. As a result, a desired hair length at certain point of the head is known. More generally, a point cloud or mesh may be provided which sufficiently describes the model haircut/hairstyle by a plurality of data sets involving positional data and associated hair property data. For illustrative purposes, aspects and embodiments of the present disclosure primarily address head hair (scalp hair) cutting and styling. However, this does not exclude an application in the field of facial hair (beard) grooming and total body grooming including intimate hair styling. Further, human hairstyling but also animal hairstyling may be addressed.

In accordance with a first approach to the preparation of hairstyle/haircut models, it has been proposed to record machine parameters of the hair cutting appliance when the haircut is actually performed, or after a haircut is performed. This may involve recording a plurality of pairs of values indicating a respective cutting length at a respective position so as to eventually generate a point cloud representing a topological hair map.

In accordance with another approach, predefined hairstyle/haircut models are generated which are not personalized but rather represent typical head shapes and therefore match a considerably large number of individuals. Hence, the hairstyle/haircut models are defined without having knowledge of the actual to be treated subject's shape (e.g. head topology).

Further, in accordance with yet another approach, users may adopt personal hairstyle/haircut models of other individuals so as to imitate their hairstyle. The models may be exchanged, shared or downloaded via a hairstyle/haircut model marketplace, or via a data link between two respective appliances. Further, a user may simply use one and the same appliance for a number of individuals which allows to copy or transfer hairstyles haircuts between those individuals.

However, in practical use, the above discussed approaches still show only a limited accuracy and performance. A large amount of manual intervention may be necessary so as to eventually apply someone else's hair model or even a standard non-personalized hair model to a certain individual, i.e. another individual. There is a certain risk that the resulting hairstyle/haircut has a somewhat artificial appearance.

Simply adopting a predefined hairstyle/haircut model and imposing it on the to-be-treated individual may result in an amateurish, non-professional hairstyle. Consequently, there is a certain need for improvements in and alternative approaches to model based automated haircut/hairstyle processing. In particular the adoption and transfer of existing hairstyle/haircut models to other individuals still faces major challenges. Hence, there is still room for improvement in automated haircut recording appliances and methods.

SUMMARY OF THE INVENTION

It is an object of the present disclosure to provide an automated hairstyle processing method, an automated hairstyle processing system and a corresponding automated hair cutting device which address at least some of the above-indicated issues.

Particularly, improvements in model based automated haircut/hairstyle processing are sought for. Preferably, embodiments in accordance with the present disclosure facilitate the exchange of hair profiles between different individuals. Further, it is desired to define an automated computer-aided hairstyle processing approach which includes an integrated feature compensation and enables a swift and proper adaption of a predefined hairstyle/haircut setting to a certain individual so as to improve the resulting overall appearance of the hairstyle.

It would be further preferred that, in accordance with the method, system and device of the present disclosure, an automated adjustment and adaption of the utilized predefined haircut/hairstyle models to characteristics of a certain individual may be achieved, or at least facilitated.

In a first aspect of the present disclosure there is presented a method of automated hairstyle processing, the method comprising the following steps:

providing a predefined hairstyle model including hair property representing values, particularly hair length representing values, and body shape representing values, particularly head shape representing values, sampling an actual body shape portion, particularly an actual head shape, of a to be treated subject, involving detecting deviations from a model body shape portion of the predefined hairstyle model, and in case deviations between the actual body shape and the model body shape portion are detected, adapting a hair property model of the predefined hairstyle model so as to compensate the actual body shape deviations.

In a further aspect of the present disclosure a system for automated hairstyle processing is presented, the system comprising:

a memory unit arranged to process a predefined hairstyle model including hair property representing values, particularly hair length representing values, and body shape representing values, particularly head shape representing values, a sampling device arranged to sample an actual body shape portion, particularly an actual head shape, of a to be treated subject, involving detecting deviations from a model body shape portion of the predefined hairstyle model, a processing unit arranged to process arranged to adapt a hair property model of the predefined hairstyle model, in case deviations between the actual body shape and the model body shape portion are detected, so as to compensate the actual body shape deviations.

In yet another aspect of the present disclosure there is provided an automated hair cutting device, particularly a hand-held device, comprising:

an engagement section, particularly a spacing comb, arranged to engage a haired portion of a subject of interest, a cutting length adjustment section, a position indicating section, and a control interface arranged to communicate with a processing unit, wherein the control interface is operable to exchange operational data, the operational data comprising hair property representing values, particularly hair length values, and body shape representing values, particularly positional data, wherein the cutting length adjustment section is operable based on the operational data so as to define an actual cutting length in accordance with the predefined hairstyle model, wherein the position indicating section is arranged to detect an actual position of the device based on which a data representation of an outer body shape of the subject may be obtained, and wherein, in case deviations between the actual body shape and the model body shape portion are detected, the cutting length adjustment section is operable based on adapted operational data so as to compensate the actual body shape deviations.

The step of adapting the hair property model involves a local adjustment of the hair property model. This involves a local adjustment of the (overall) hairstyle model as the underlying contour model is somewhat changed.

Major embodiments and aspects of the current disclosure are based on the insight that an adaption of a predefined hairstyle model to an actual individual may further improve the appearance and the resulting shape of the resulting hairstyle. Further, as automated hair cutting or hairstyling basically requires that a current position of the hair cutting device with respect to the head of the individual is monitored, the data required for an adaptation of the hairstyle model is, so to say, obtained as a byproduct and does not require huge structural modifications at the level of such a "smart" hair cutting device.

Hence, an actual shape of the to-be-treated individual and a predefined shape based on which the predefined hairstyle model is generated may be matched so as to detect the deviations (also referred to as significant deviations) therebetween which might have an adverse effect on the resulting hairstyle.

Generally, a generic, predefined hairstyle model may be present which includes a generic hair property or hair length model. Further, an adapted actual hairstyle model may be processed which includes an adapted actual hair property or hair length model.

Exemplary embodiments of the present disclosure relate to processing considerable (notable) detection between the actual body shape and the model body shape. Accordingly, in an exemplary embodiment of the method, the step of detecting deviations of the actual body shape portion from the model body shape portion of the predefined hairstyle model involves detecting considerable deviations that exceed a defined range or threshold, and wherein the step of adapting the hair property model of the predefined hairstyle model is performed when considerable deviations are present.

As used herein, the term considerable deviations relates to deviations that exceed an allowed deviation level. The allowed deviation level involves a defined range or threshold value. Defining allowed ranges or thresholds for body/head shape variations may be a practical measure as basically each individual's shape is at least slightly different from basically any other subject's shape. Hence, absolute or relative values may be defined so as to classify detected deviations and to label them as acceptable deviations or as non-standard deviations the presence of which triggers a compensation or adaption action on the model level. For instance, an imaginary "envelope" for the model shape may be defined which represents an accepted tolerance level for the sampled actual head or body shape.

The subject may be a human being, but also an animal. The body shape of interest is basically a haired body portion, particularly a haired skin or scalp portion. Further, also adjacent portions may be of interest, for instance a skin portion, a neck portion or an ear portion, which may influence the automated hair cutting or hair styling operation.

The head shape may be also referred to as scalp shape. Generally, actual skin or scalp contours of the individual subject of interest may be addressed, since notable deviations from a model contour may be present.

In an exemplary embodiment of the method, an overall appearance of a processed haircut is maintained within an accepted tolerance level by adapting the hair property representing values of the hairstyle model. This may be achieved even when considerably huge deviations of the level of the skin are present. Hence, even if deformations or other exceptional features are present, the desired resulting hairstyle or haircut look and appearance may be maintained. Since for instance a model scalp contour does not comprise uncommon exceptional depressions or elevations, the presence of such exceptional features in real life applications might be reflected in respective deviations in shape of the hairstyle contour. In accordance with exemplary embodiments of the present disclosure those resulting unsightly deviations at the hair level may be avoided or at least considerably reduced. The accepted tolerance level may be a defined tolerance range or a defined threshold value for the resulting hairstyle contour, for instance. The accepted tolerance level may involve one of absolute tolerance values and relative tolerance values.

Hence, even when a certain deviation level at the body/head shape is present, a resulting deviation level at the hairstyle contour may be significantly reduced by adapting for instance the hair length values of the involved region(s) accordingly.

In a further exemplary embodiment of the method, the predefined hairstyle model includes a topological hair model including a set of data points involving position values and hair property values, particularly hair length values. The topological hair model may involve a skin or scalp shape model representing the (three-dimensional) contour and the level of the skin, and a hair property model, particularly a hair length model, defining the to-be-processed length of the hair at a certain position of the skin or scalp where the hair grows. In a further exemplary embodiment of the method, the step of adapting the hair property model comprises:

in case depressed features with respect to the model body shape portion are detected, adding a compensating offset to involved hair property representing values, particularly hair length values, and in case elevated features with respect to the model body shape portion are detected, deducting a compensating offset from involved hair property representing values, particularly hair length values.

Hence, a smooth and leveled haircut appearance may be achieved.

In a further exemplary embodiment of the method, the step of adapting the hair property model comprises:

in case displaced features are detected, adding a relocating offset to involved hair property representing values, particularly hair length values or hair presence values.

In a further exemplary embodiment of the method, the step of adapting the hair property model comprises:

in case unsymmetrical features at respective sides of the skin or head are detected, adding a balancing offset to involved hair property representing values, particularly hair length values or hair presence values.

Unsymmetrical features and/or displaced features may be present in a great number of individuals. Typically, the left side and the right side of the head of an individual are not perfectly mirror symmetric. Rather, for instance, the position and the shape of the left ear and the right ear may somewhat deviate from one another. Further, accidents, surgical treatment, burn injuries, and suchlike may cause non-conform features than may be detected and that may induce a respective adaption of the hairstyle model.

In a further exemplary embodiment of the method, the step of sampling the actual body shape is performed when the hair of subject of interest is processed, and wherein an in-process adaption of the hair property model is performed. Hence, no separate sampling procedure is necessary. For instance, this embodiment may involve that initially regions are processed which are not prone to deviations, and wherein, when the hair cutting operation progresses, contour deviations may be detected so as to promptly adapt the hair length model for involved deviating regions/spots.

In a further exemplary embodiment of the method, the sampled actual body shape is used for an adaption of the hair property model for a subsequent hair processing operation. This may have to advantage that the actual contour may be sampled before an adaption actually takes place. Hence, a match between or a comparison of the predefined sample contour and the actual contour may be processed and assessed. As a result, the actual hairstyle model may be defined. A general objective may be for instance applying only a minimum level of adaptions.

In a further exemplary embodiment of the method, the step of sampling the actual body shape is performed in a sampling mode, preferably prior to a subsequent hair processing operation in which an adapted hair property model is used. This may have the advantage that a pure sampling stage may be performed which ensures a fine-meshed sampling and generation of the actual shape model.

In a further exemplary embodiment of the method, an iteration procedure is performed involving a repetitive refinement of the body shape sampling and the hair property model adaption. Hence, the quality and appearance of the resulting haircut may be gradually improved as a further detailed and adjusted actual hairstyle model may be obtained. Repetitive refinement may involve applying an approximation and/or iteration algorithm. For instance least mean squares approximation and similar algorithms may be applied to define the adapted hairstyle model.

In a further exemplary embodiment of the method, the step of sampling the actual body shape involves providing a position indicating section that is arranged, when moved in an arbitrary and/or targeted fashion, to record a point cloud representing the outer shape of a skin portion of a part of the body of the to be treated subject.

In an exemplary embodiment of the automated hairstyle processing system, the system further comprises a position determination unit that is arranged to record a point cloud representing the outer shape of a skin portion of a part of the body of the to be treated subject. Hence, by moving an involved hair cutting device, in the vicinity of or in contact with the skin or scalp of the individual, an outer boundary of the body portion of interest (e.g. head portion) may be sampled which gradually generates a model of the actual skin/scalp contour of the individual. For instance, given a certain sampling rate, a point cloud including a plurality of contact points where the device touches the skin may be generated. More generally, a three-dimensional (contact or non-contact) scan of the individual's contour of interest may be obtained.

In yet another aspect of the present invention there is provided a computer program which comprises program code means for causing a computing device to perform the steps of the methods as discussed herein when said computer program is carried out on that computing device.

The program code can be encoded in one or more non-transitory, tangible media for execution by a computing machine, such as a computer. In some exemplary embodiments, the program code may be downloaded over a network to a persistent memory unit or storage from another device or data processing system through computer readable signal media for use within the system. For instance, program code stored in a computer readable memory unit or storage medium in a server data processing system may be downloaded over a network from the server to the system. The data processing device providing program code may be a server computer, a client computer, or some other device capable of storing and transmitting program code.

As used herein, the term "computer" may stand for a large variety of processing devices. In other words, also mobile devices having a considerable computing capacity can be referred to as computing devices, even though they provide less processing power resources than standard "computers". Needless to say, such a "computer" can be part of a personal care device and/or system. Furthermore, the term "computer" may also refer to a distributed computing device which may involve or make use of computing capacity provided in a cloud environment. The term "computer" or "computing" may also relate to medical technology devices, health tech devices, personal care devices, fitness equipment devices, and monitoring devices in general, that are capable of processing data. Any automated information processing device or system capable of processing respective data may be referred to as computing device.

Preferred embodiments of the disclosure are defined in the dependent claims. It should be understood that the claimed method and the claimed computer program can have similar preferred embodiments as the claimed system and the claimed device and as defined in the dependent system/device claims, and vice versa.

BRIEF DESCRIPTION OF THE DRAWINGS

These and other aspects of the invention will be apparent from and elucidated with reference to the embodiments described hereinafter. In the following drawings

DETAILED DESCRIPTION OF THE EMBODIMENTS

Figure 1:
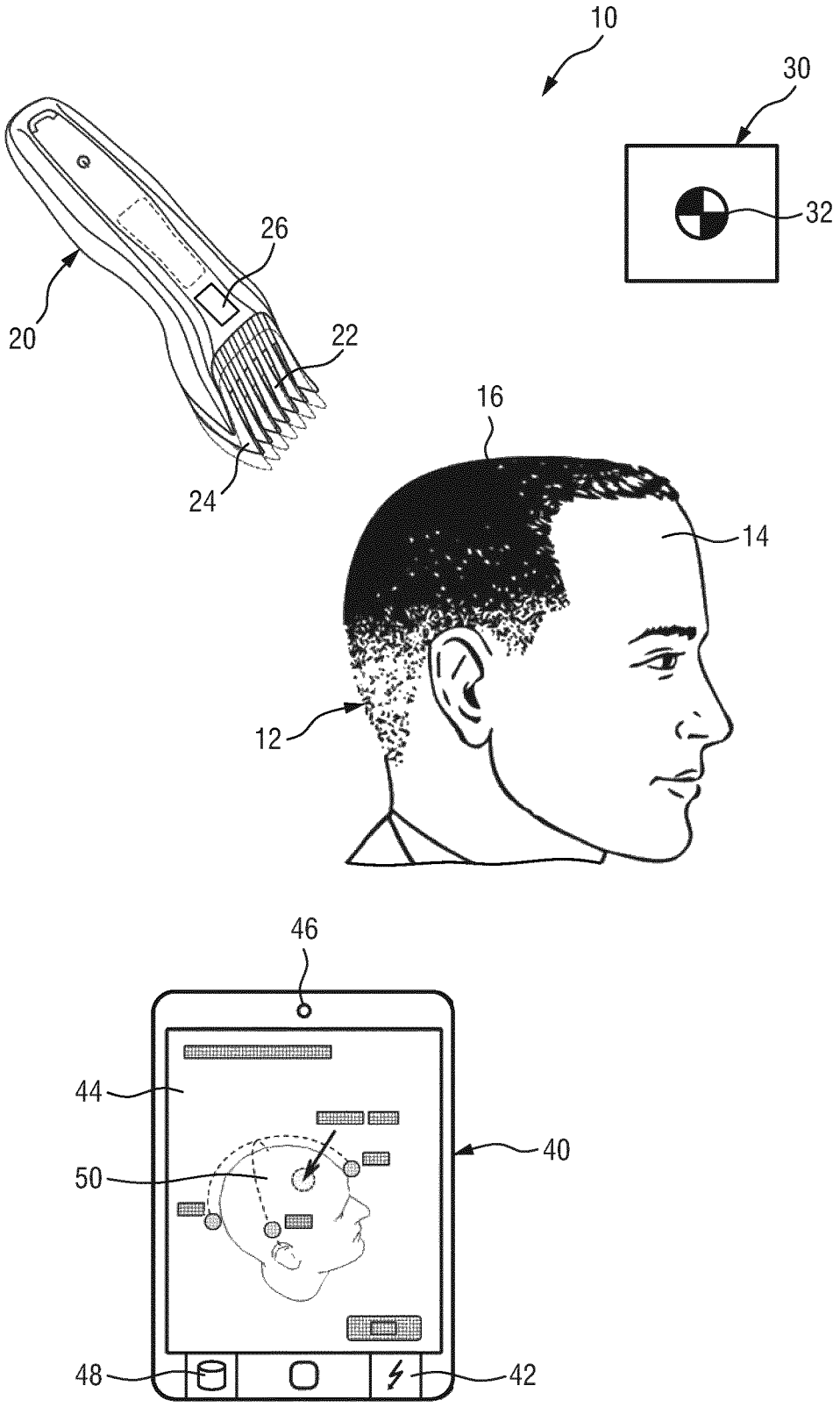
FIG. 1 shows a simplified general layout of an exemplary embodiment of an automated hairstyle processing system.

FIG. 1 shows a simplified schematic illustration of an automated hairstyle processing system 10. The hairstyle processing system 10 may be also referred to as automated haircut processing system. The system 10 is arranged to perform a haircut or hairstyling operation at a client or subject 12, wherein the system 10 is capable of reproducing a previously defined haircut or hairstyle on demand. In FIG. 1, a haired portion 16 at a head or scalp portion 14 of the subject 12 is illustrated. The system 10 is arranged as a "smart" hair cutting or hair styling system.

As already indicated further above, the present disclosure generally relates to grooming, processing and styling human hair and animal hair which involves head hair and body hair.

The system 10 comprises a hair cutting device 20 which may be also referred to as automated hair cutting device. The device 20 is arranged as a hand-held or hand-guided device. The device 20 may be basically arranged as a hair cutting appliance which is supplemented by additional processing and control capabilities. Generally, the device 20 may be grasped by a user and operated so as to cut hair at the subject 12. This may involve moving the device 20 through the haired portion 16 at the head portion 14 of the subject 12 and cutting hairs to a desired length.

The device 20 may be held and operated by the subject 12 itself (whose haircut is to be processed). In the alternative, the device 20 may be operated by another individual. The operator of the hand-held device 20 shall be referred to hereinafter as the user.

Figure 4:
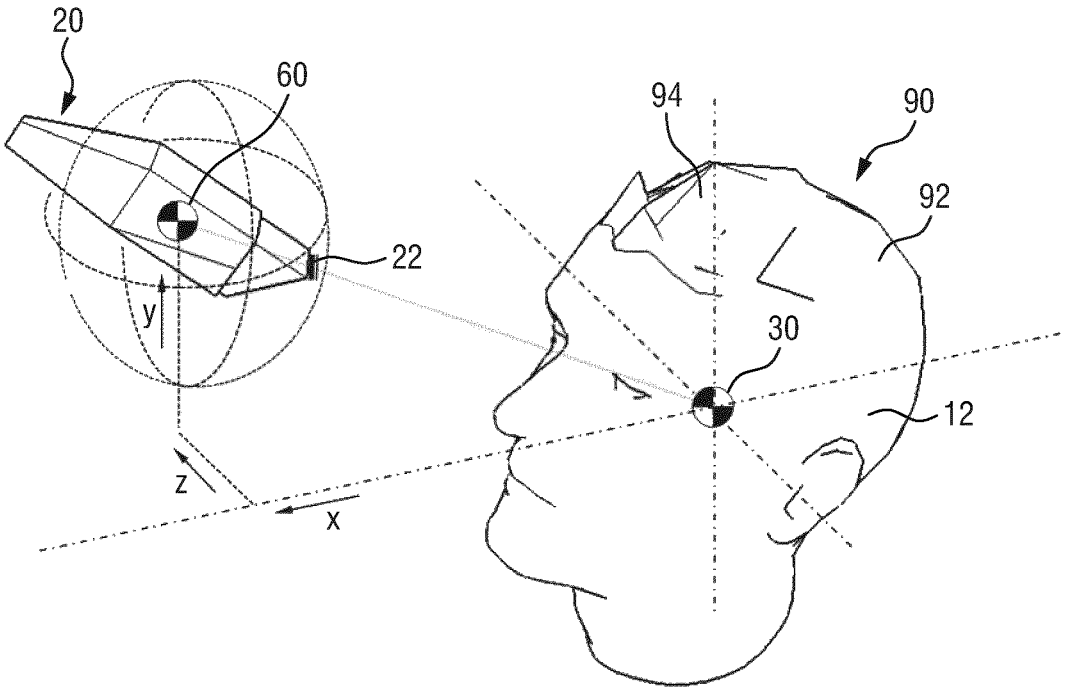
FIG. 4 shows a simplified schematic perspective representation of a head of a subject of interest in relation to which a hand-held device for haircut processing is arranged.

The device 20 comprises a blade set 22 which is not explicitly shown in FIG. 1 (refer also to the alternative representation of the device 20 in FIG. 4). In FIG. 1, the blade set 22 is covered by a comb 24. The comb 24 may be also referred to as adjustable spacing comb. Further, an adjustment unit 26 is provided at the device 20. For instance, the adjustment unit 26 is arranged to operate and adjust the comb 24 so as to define an actual cutting or trimming length of the device 20. The comb 24 defines an offset between a skin or scalp level at the subject 12 and a cutting edge of the blade set 22. Consequently, the adjustment unit 26 may be controlled and operated so as to control the comb 24 dependent on an actual position of the device 20 with respect to the haired portion 16 of the subject 12. Consequently, assuming that an appropriate control based on a hairstyle model involving position data and hair cutting length data is provided, the user may adequately trim and style the subject's 12 hair, even in the absence of professional hairstyling knowledge.

The system 10 further comprises a position determination unit 30 which may be also referred to as tracking unit or position detection unit. The position determination unit 30 is indicated in FIG. 1 by a simplified bock. The unit 30 comprises a positional reference 32. There exist several embodiments of the position detection unit 30. Reference is made again to WO 2013/163999 A1 in this context. Generally, the main purpose of the position determination unit 30 is to detect a current position of the device 20 with respect to the haired portion 16 or the head portion (scalp) 14 of the subject 12. Consequently, the actual position of the device 20 with respect to the subject 12 may be assigned to a respective hair property value, particularly to a hair length value which enables an automated hair processing wherein the adjustment unit 26 of the device 20 ensures a correct setting of the comb 24 so as to eventually achieve the desired hair length.

As exemplarily shown in FIG. 1, also a computing device 40 may form part of the system 10. This may be for instance the case when the device 20 as such does not provide sufficient data processing and computing capacity. The computing device 40 may be arranged as a mobile device, for instance a tablet computer, a mobile phone and such like. The computing device 40 comprises a processing unit 42 including at least one processor (CPU) arranged to process operational data for the system 10.

Further, user feedback units 44, 46 may be provided so as to establish an interaction between the user and the hair cutting device 20 via the computing device 40. For instance, the user feedback units may comprise a display or screen 44 and speakers 46. The computing device 40 may further comprise a memory unit 48 which may be arranged to store hairstyle and/or haircut models. Further operational data may be stored in the memory unit 48. In FIG. 1, visual information 50 is displayed as the screen 44. This may further facilitate operating the hair cutting device 20.

As will be discussed further below, the hair cutting device 20 and the computing device 40 are preferably arranged to exchange data therebetween. This may for instance involve a wireless and/or a cable communication.

There are further embodiments of the system 10 wherein the hair cutting device 20 as such provides sufficient computing capacity. However, also if this is the case, providing the computing device 40 may be beneficial for a setup and further configuration operations.

Figure 2:
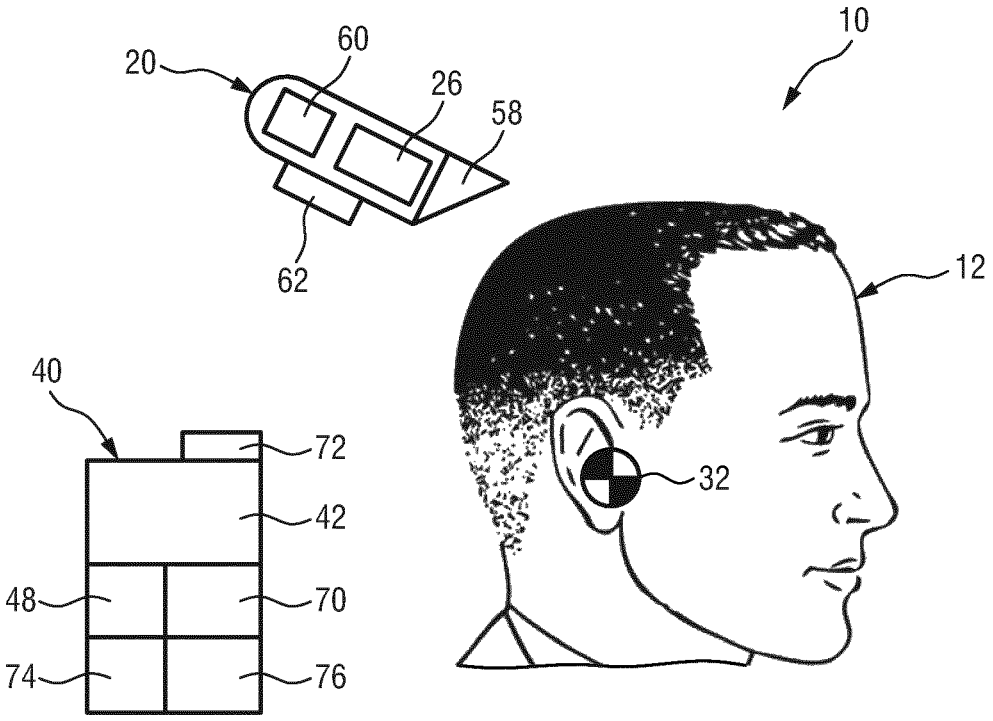
FIG. 2 shows another alternative layout of an embodiment of an automated hairstyle processing system.
Figure 3:
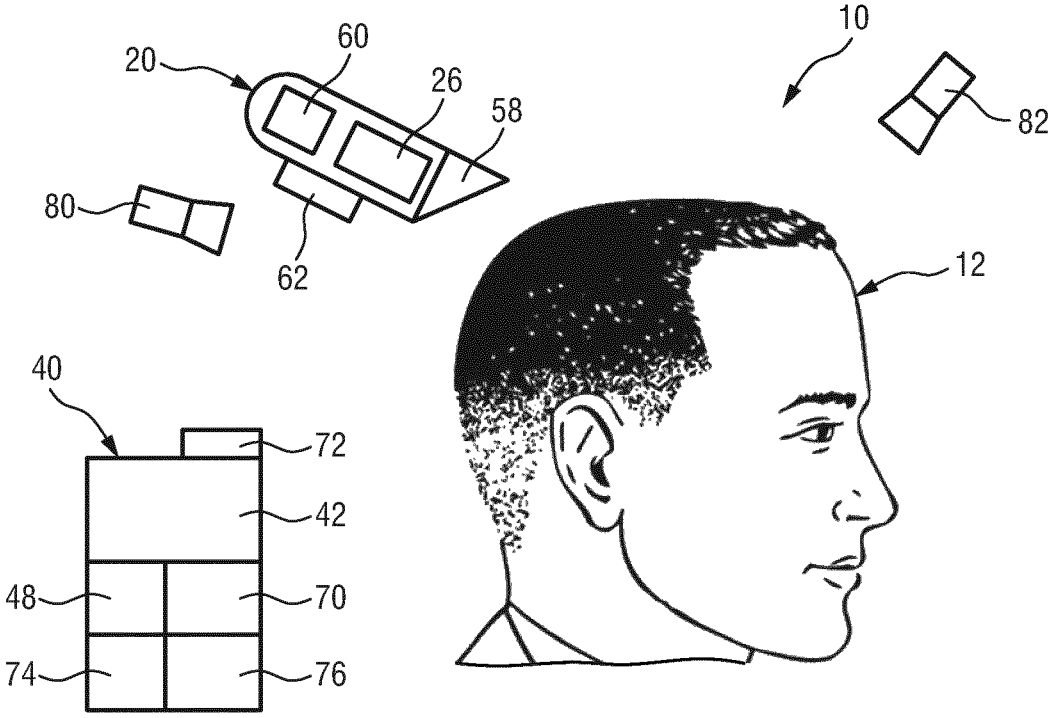
FIG. 3 shows yet another exemplary layout of an embodiment of an automated hairstyle processing system.

FIG. 2 illustrates an exemplary embodiment of an automated hairstyle processing system 10 which may generally correspond to the embodiment already explained above in connection with FIG. 1. Further, FIG. 3 illustrates yet another exemplary embodiment of an automated hairstyle processing system 10 having a general layout which also basically corresponds to the layouts as illustrated in FIGS. 1 and 2.

In FIG. 2, the system 10 comprises a hand-held hair cutting device 20 implementing an adjustment unit 26. The adjustment unit 26 is operatively coupled with an engagement section 58. Typically, the engagement section 58 involves a comb 24, refer also to FIG. 1. The adjustment unit 26 controls an actual state of the engagement section 58 so as to set an actual cutting length. The device 20 further comprises a position indicating section 60. The section 60 allows to detect a current (absolute or relative) position of the device 20 and to track a movement path of the device 20 accordingly. Hence, when the device 20 is moved along the subject's 12 scalp, an actual shape of the head or scalp of the subject 12 is sampled, captured or scanned. In this way, a model of the actual shape of the to-be-treated portion of the subject 12 may be obtained.

In some embodiments, the position indicating section 60 is operable to cooperate with a positional reference 32. In FIG. 2, the positional reference 32 is a wearable reference worn by the subject 12. For instance, an ear wearable reference as disclosed in WO 2013/163999 A1 may be utilized. Consequently, a relative position of the device 20 with respect to the positional reference 32 may be detected and tracked. Hence, a current position of the device 20 at the head of the subject 12 can be processed.

The device 20 further comprises a control interface 62 through which data and information may be exchanged. In one embodiment of the system 10, the device 20, the position determination unit 30 and the computing device 40 (refer also to FIG. 1) are arranged to communicate with one another, preferably in a wireless fashion. Consequently, also the computing device 40 shown in FIG. 2 may comprise a control interface 72. Between the control interface 62 and the control interface 72, a data transfer link may be established. In addition, also the positional reference 32, or the position determination unit 30 as such, may be provided with a corresponding control interface (not shown in FIG. 2).

Hence, a sampling unit 74 of the computing device 40 may be supplied with samples which involve the actual position of the device 20 with respect to the positional reference 32 and, consequently, with respect to the subject 12. Hence, by moving the device 20 along and in close proximity to the head of the subject 12, a virtual data representation of the actual shape thereof may be obtained. In other words, assuming that a certain sampling rate is used, a point cloud, data mash or data set may be generated which represents the shape of at least a part of the head 14.

The computing device 40 as shown in FIG. 2 further comprises a model adaption unit 70 and a deviation detection unit 76. The deviation detection unit 76 is arranged to perform a nominal-actual comparison so as to assess whether an actual shape of the treatment portion of the subject 12 sufficiently corresponds to the predefined model based on which the hairstyle model is generated. As indicated above, the device 20 may be operated based on the hairstyle model so as to ensure an automated hair cutting action.

In case the deviation detection unit 76 detects a significant deviation, for instance a considerable protrusion or depression at the scalp of the subject 12, the model adaption unit 70 may adapt the hairstyle model accordingly so as to ensure the desired overall appearance and accuracy of the haircut.

The computing device 40 of FIG. 2 is further provided with a memory unit 48 which is arranged to at least temporarily store a predefined hairstyle or haircut model and, if necessary, an adjusted or adapted hairstyle/haircut model which is assigned to the actual (individual) subject 12.

The arrangement of FIG. 3 basically differs from the arrangement of FIG. 2 in that remote visual position sensors 80, 82 are provided for position detection. For instance, video cameras may be provided so as to monitor the subject 12 and the device 20 from different positions so as to enable a three-dimensional tracking of the position of the device 20 with respect to the head or scalp of the subject 12. Images obtained by the position sensors 80, 82 may be processed so as to detect and track the requested position (e.g., contact of device 20 and scalp) accordingly. Also in this way, a current position of the device 20 may be detected and sampled so as to generate an actual representation of the shape of the head or scalp of the subject 12.

Needless to say, remote position sensors as illustrated in FIG. 3 and wearable positional references as illustrated in FIG. 2 may be combined so as to further improve the position detection performance. The position determination unit 30 used in the embodiment of FIG. 2 may for instance involve an electromagnetic field (EMF) position detection sensor.

FIG. 4 exemplarily illustrates a simplified model representation of a subject's 12 head. Further, a coordinate system is indicated in FIG. 4 by dot-dashed lines. Arrows indicated by X, Y and Z indicate respective directions. A (virtual) origin of the coordinate system of FIG. 4 is for instance in the center of the head of the subject 12. Consequently, a hairstyle or haircut model 90 may be defined with reference to the coordinate system X, Y and Z. The hairstyle model 90 may be also referred to as hair topology model.

The hairstyle model 90 involves a scalp or head model 92 describing a model shape of the subject 12, i.e. at the level of the skin or scalp. The hairstyle or haircut model 90 further involves a hair length model 94 which may be also referred to as hair property model. The hair length model 94 involves respective hair length values associated with respective positions at the model 92 representing a skin or scalp contour of the subject 12. The scalp model 92 and the hair length model 94 jointly form the hairstyle model 90. Hence, when performing a hair cutting operation, the position determination unit 30 (FIG. 1) and the position indicating section 60 detect and track an actual position of the device 20 based on which an actual (length) setting of the device 20 may be adjusted and controlled. This feature also may be used to generate an actual model of a to-be-treated individual. Hence, scanning or sampling the head or scalp topology may be considered as a reverse scanning or reverse sampling approach using structural features which are anyway provided in a smart hairstyle processing system 10.

Figure 5:
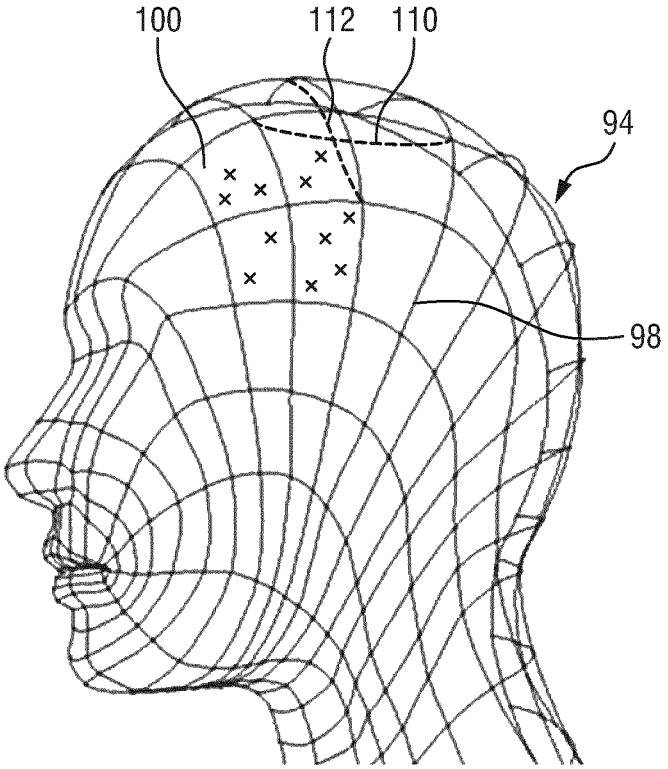
FIG. 5 shows a simplified side view of a head to which an illustrative contour line topology pattern is applied.

FIG. 5 exemplifies a simplified three-dimensional representation of a head which is based on contour lines 98. The illustration of FIG. 5 exemplifies a scalp model 92. The scalp model 92 is basically generated on the basis of a plurality of points 100. The points 100 form a point cloud based on which the scalp model 92 may be established.

As indicated above, the scalp model 92 does not necessarily match an actual individual. Rather, the scalp model 92 may represent a predefined model corresponding to another individual or to a fictional standard person.

However, it has been observed that in many individuals considerable deviations of the head or scalp shape are present. An actual scalp shape of the individual shown in FIG. 5 may for instance involve a deviation 110 indicated by dashed lines at a top portion of the head. For instance, the deviation 110 may involve a deformation 112, particularly a depression or deepening at the scalp.

Assuming that the predefined hairstyle model 90 is imposed on the actual individual without compensating the deviation 110, a respective deviation would be also present at the processed haircut as the depression 112 would be reflected in a corresponding hairstyle imperfection.

Therefore, in accordance with at least some embodiments and aspects of the present disclosure, it is proposed to detect respective deviations so as to obtain an actual scalp shape based on which the predefined hairstyle model may be adjusted so as to ensure that the resulting haircut can be achieved at the desired accuracy and appearance.

Figure 6:
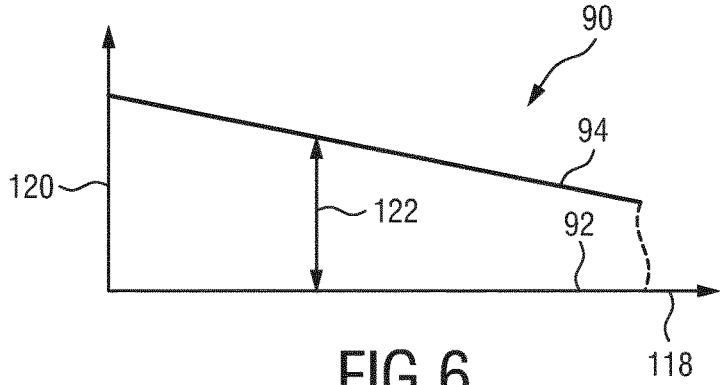
FIG. 6 illustrates a simplified chart representing an exemplary embodiment of a hairstyle model.
Figure 7:
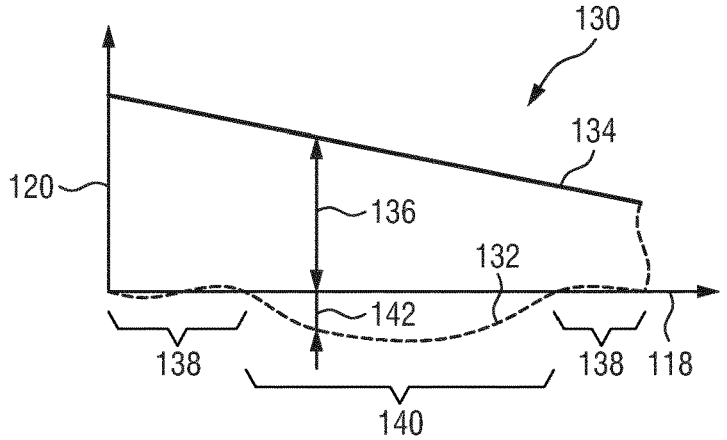
FIG. 7 illustrates a simplified chart representing an actual adapted hairstyle model which is based on the hairstyle model illustrated in FIG. 6.

With reference to FIG. 6 and to FIG. 7, an exemplary approach to the hairstyle model adaption is explained and further detailed. FIG. 6 and FIG. 7 respectively show a chart that represents a (simplified) subset of three-dimensional hairstyle models as discussed further above with reference to FIG. 4 and to FIG. 5.

The chart of FIG. 6 relates to a predefined or generic hairstyle model 90. The chart of FIG. 7 relates to an adapted (actual) hairstyle model 130.

In FIG. 6 and FIG. 7, an axis of abscissas 118 indicates a (straightened) normal level of the skin or scalp. For instance, a two-dimensional path at the level of the skin or scalp may be exemplified by the axes 118 of FIG. 6 and FIG. 7. Further, ordinate axes 120 in FIG. 6 and FIG. 7 indicate hair length values at a certain position at the paths 118.

In the predefined hairstyle model 90 illustrated in FIG. 6, the path of the scalp model 92 is basically straight or even and therefore aligned with the normal path axis 118. Further, an exemplary hair length curve (in the form of a constant transition) of the hair length model 94 is exemplified. For a certain position along the path 92, a respectively defined hair length value 122 is provided.

The actual hairstyle model 130 of FIG. 7 takes account of an actual scalp shape 132 which is illustrated in FIG. 7 by a dashed line. The path along the actual scalp shape 132 is not even or normal but rather somewhat uneven or curved. Hence, in case deviations with respect to the predefined (assumed) level of the scalp model 92 (FIG. 6) are present, this would result in a respectively uneven and curved shape of the processed hair. It is therefore proposed to compensate actual body shape deviations by calculating respectively adapted hair length values 136. The hair length value 136 of FIG. 7 is based on the hair length value 122 of FIG. 6 to which a compensating offset 142 is applied. Hence, by tracking and sampling the actual shape of the scalp or head of the actual individual, it may be ensured that the haircut that is processed based on the adapted hairstyle model 130 at least substantially corresponds to the desired (ideal) shape of the haircut described by the predefined hairstyle model 90.

As further indicated in FIG. 7, regions 138 may be defined wherein no compensation takes place. Further, regions 140 may be defined wherein compensation takes place. So as to facilitate the adaption of the hairstyle model, respective thresholds may be defined, wherein a deviation must exceed a certain limit or threshold so as to trigger an adaption of the hairstyle model. Hence, slight deviations, which are always present, do not necessarily induce an effortful compensation process.

The compensation approach illustrated in FIGS. 6 and 7 may be used to compensate local indentations, depressions, elevations and further deviations in shape.

Figure 8:
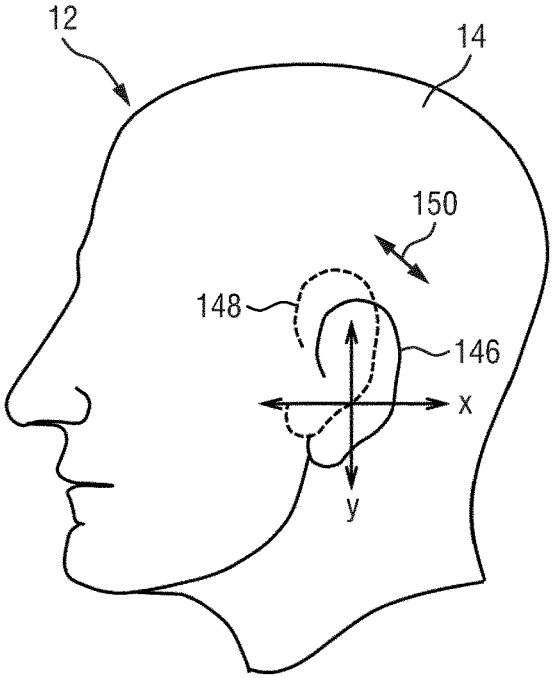
FIG. 8 shows a simplified side view of a subject of interest illustrating displaced features which induce an adaption of a hairstyle model.

However, further types of deviations may be present. In this context, reference is made to FIG. 8 illustrating a simplified side view of a head 14 of a subject 12. In addition to a general shape of the head or scalp of the subject 12, also the presence, shape and location of features may have an impact on the outcome of the automated hairstyle process. In FIG. 8, a feature 146 is shown which illustrates an ear of the subject 12. Further, a dashed line representation of a displaced feature 148 is shown. The ears 146, 148 in different individuals are not necessarily at the same (relative) position at the head 14. Similarly, also the position of eyebrows, the nose, the neck and further features may vary among individuals. Also displaced features 148 may have a negative impact on the resulting appearance and accuracy of the haircut. It is therefore proposed to adapt the predefined hairstyle model 90 accordingly to compensate the displaced features 148.

Basically the same may apply to unsymmetrical features which may for instance involve a left ear and a right ear that are arranged at a different height level at the head of one and the same individual.

Generally, a relocating offset 150 may be derived and applied to the hairstyle model which may for instance trigger a relocation of a model hairline.

Figure 9:
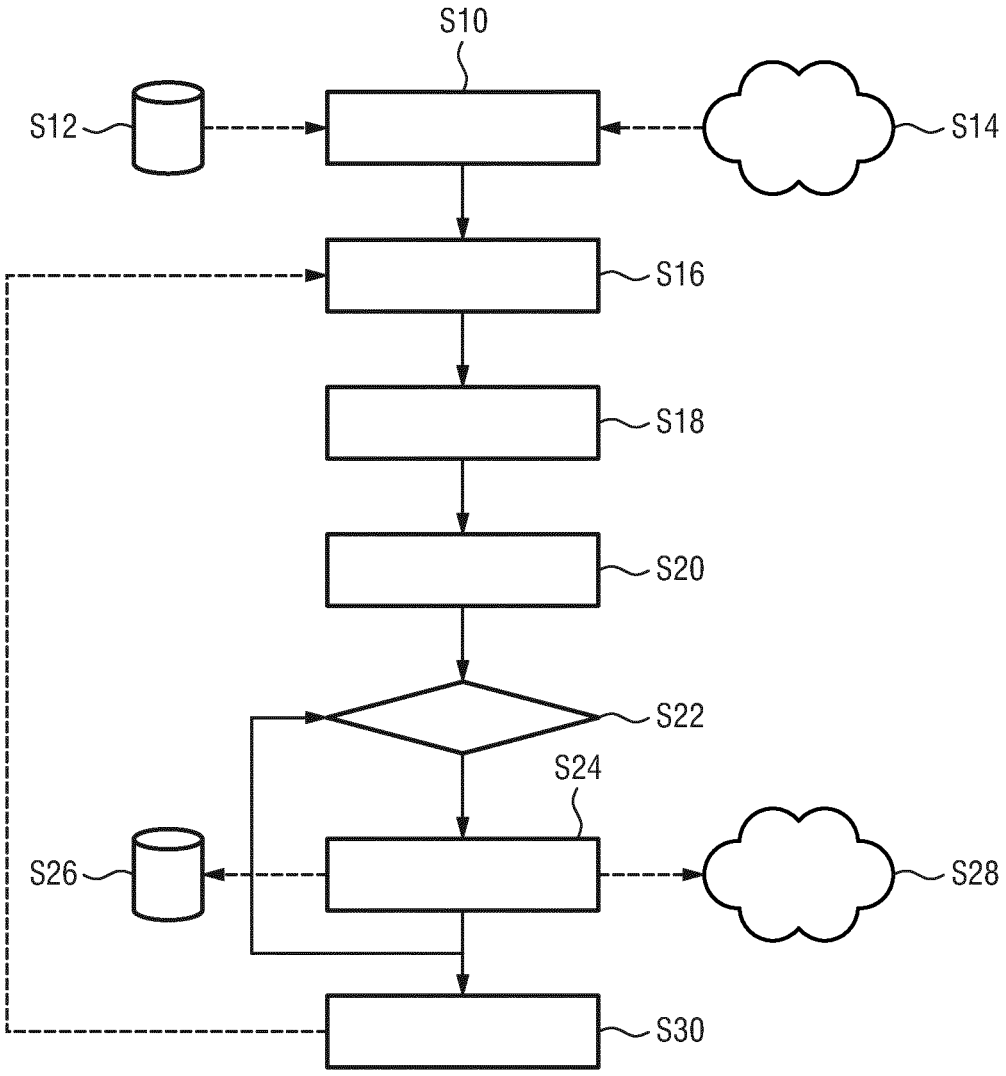
FIG. 9 shows a simplified block diagram of an embodiment of a method of automated hairstyle processing.

Reference is made to FIG. 9 showing a simplified block diagram illustrating an embodiment of a method of automated hairstyle processing.

The method involves a first step S10 which includes providing a hairstyle or haircut model for a hair cutting operation. The hairstyle model involves a combined scalp and hair length model defining position-dependent hair length values. The hairstyle model may be provided from a memory unit, step S12. In the alternative, the hairstyle model may be obtained from a cloud or online environment, step S14.

The method may further involve a step S16 which includes detecting a current position of a hand-held device with respect to a body portion of interest of a to-be-treated subject. A sampling step S18 may follow which includes sampling a large number of position values which may result in a point cloud which generates a representation of at least a portion of the head or scalp of the subject.

In yet another step S20, deviations between the detected actual head model and a head model underlying the predefined hairstyle model are detected. The deviations may for instance involve depressions, elevations, dislocated features, asymmetric features, etc.

A decision step S22 may follow which includes an assessment as to whether or not the detected deviations are within a defined (allowed) range. In case the deviations exceed the defined range or threshold, an adaption step S24 may follow. Consequently, the hairstyle model may be adapted to current conditions, particularly to an actual head or scalp shape. The adapted model may be stored in the memory unit, step S26, or may be distributed via a cloud or online environment, step S28.

A further step S30 involves the hair processing or hair cutting operation as such. Automated hair cutting involves so-called smart hair cutting devices which are arranged to adapt or adjust the current hair length dependent on an actual position of the device, for instance by operating a motorized spacing comb. Therefore, also an unexperienced or non-professional user may achieve haircuts and hairstyles at a considerably impressive quality level.

In the step S30, the adapted model processed in a step S24 may be used. When it is assessed in the decision step S22 that the deviations are small enough so that no adaption of the hairstyle model is required, the adaption step S24 may be bypassed.

As indicated by a dashed arrow connecting the blocks for the steps S30 and S16, the hairstyle model adaptation may be an iterative process. For instance, when one and the same individual is treated several times, allowed deviations from the predefined contour or shape model may be gradually reduced so as to further improve the hairstyle appearance.

Figure 10:
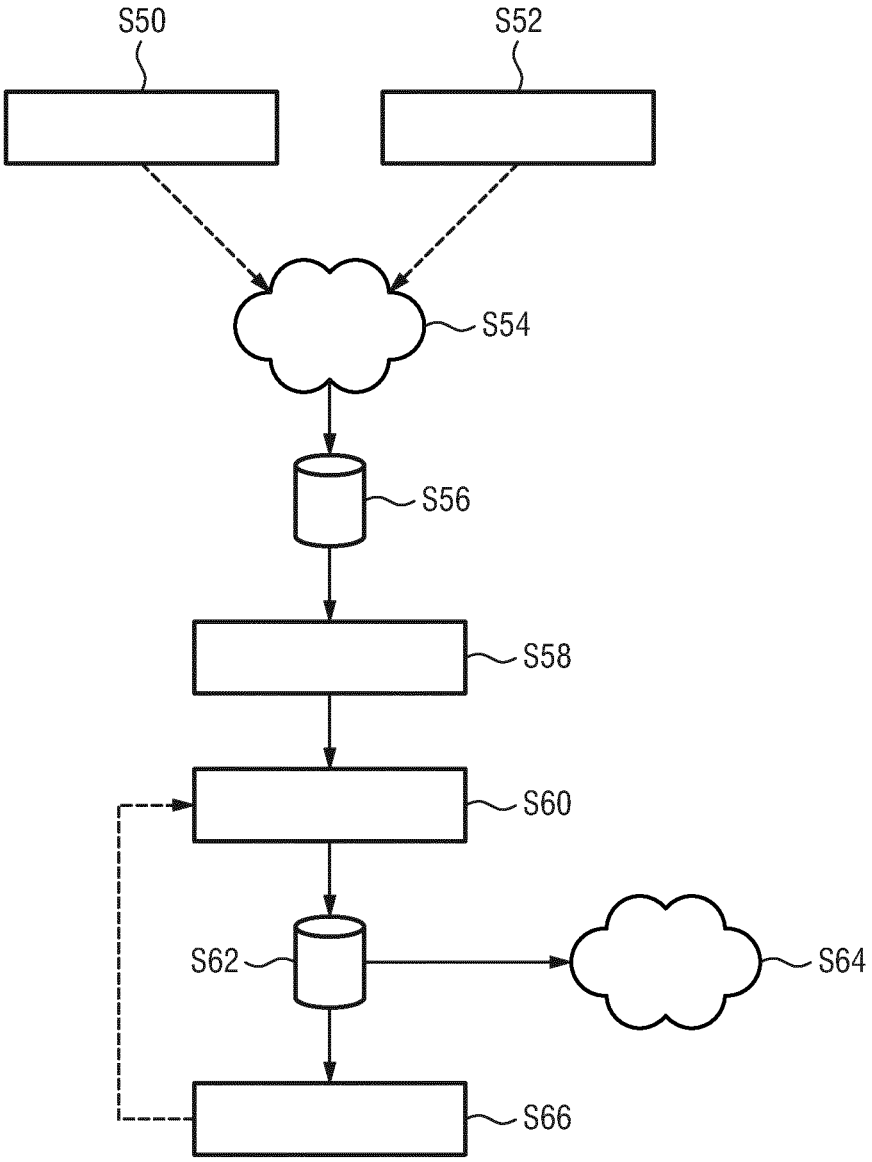
FIG. 10 shows a simplified block diagram of yet another embodiment of a method of automated hairstyle processing.

FIG. 10 shows a further simplified block diagram illustrating another embodiment of an automated hairstyle processing method. The method as illustrated in FIG. 10 may complement the method of FIG. 9.

In FIG. 10, a step S50 describes the generation of a predefined hairstyle model. The step S50 may involve defining a standard individual having a standard head or scalp shape.

In the alternative or in addition, a step S52 may be provided which involves the generation of a hairstyle model by another individual whose hair is styled. Both generic models as provided by the step S50 and individual models as provided by the step S52 may form a basis for a model adaption procedure as discussed herein.

For instance, the models provided by the steps S50 and S52 may be distributed via a cloud environment, step S54. The models may be downloaded or otherwise stored in a memory unit, step S56. A further subsequent step S58 involves selecting and providing a respective hairstyle model for a planned hairstyling operation.

A further step S60 may follow which involves a model adaption to a certain individual. As already discussed above, the model adaption may involve a detection of the individual's head or scalp shape and, consequently, a match of the predefined shape and the individual's shape. In case significant deviations are detected, an adaption and adjustment action may take place.

The adapted model may be stored in a memory unit, step S62. Further, the adapted model may be distributed via an online or cloud environment, step S64.

A further step S66 involves the desired hair processing operation which is based on the adapted model. As indicated by a dashed line that connects the boxes indicating the steps S60 and S66, also the hair processing operation may be used to further refine and adapt the underlying hairstyle model.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A method of hairstyle processing comprising acts of:

receiving, from a memory, a predefined hairstyle model including hair property representing values and body shape representing values;

sampling, by a sampling device, an actual body shape portion, of a to be treated subject;

detecting, by a configured processor, deviations between the actual body shape portion of the subject and a model body shape portion of the predefined hairstyle model, wherein the actual body shape portion of the subject and the model body shape portion include corresponding representing values for both a contour of a hair portion and a level of skin at the hair portion; and adapting, by the processor, a hair property model of the predefined hairstyle model to compensate for the actual body shape deviations when the deviations between the actual body shape portion and the model body shape portion exceed a predetermined threshold;

wherein the act of adapting the hair property model involves the processor adjusting only portions of the hair property model wherein the deviations between the actual body shape portion and the model body shape portion exceed the predetermined threshold such that less than all the portions of the hair property model are adapted.

2. The method as claimed in claim 1, wherein the predetermined threshold is a predetermined range, the method comprising an act of the processor detecting deviations of the actual body shape portion from the model body shape portion of the predefined hairstyle model by detecting deviations that exceed the predetermined range, and wherein the act of adapting the hair property model of the predefined hairstyle model is performed only when the predetermined range is exceeded.

3. The method as claimed in claim 1, wherein a processed haircut is achieved by adapting the hair property representing values of the hairstyle model to account for at least one of elevations and depressions in the level of skin at the hair portion.

4. The method as claimed in claim 1, wherein the predefined hairstyle model includes a topological hair model including a set of data points involving individual position values, corresponding hair length values and the level of skin.

5. The method as claimed in claim 1, wherein the act of adapting the hair property model comprises at least one of the following acts:

when depressed features with respect to the model body shape portion are detected, the processor adding a compensating offset to involved hair property representing values, when elevated features with respect to the model body shape portion are detected, the processor deducting a compensating offset from involved hair property representing values, and when displaced features or unsymmetrical features at respective sides of the skin or head are detected, the processor adding a relocating offset to involved hair property representing values or hair presence values.

6. The method as claimed in claim 1, wherein the act of sampling the actual body shape is performed when the hair of the to be treated subject is processed, and wherein an in-process adaption of the hair property model is performed.

7. The method as claimed in claim 1, wherein the sampled actual body shape is used for the adaption of the hair property model for a subsequent hair processing operation.

8. The method as claimed in claim 7, wherein an iteration procedure is performed involving a repetitive refinement of the body shape sampling and the hair property model adaption.

9. The method as claimed in claim 1, wherein the act of sampling the actual body shape is performed in a sampling mode, prior to a subsequent hair processing operation in which the adapted hair property model is used.

10. The method as claimed in claim 1, wherein the act of sampling the actual body shape involves providing a position indicating section that is arranged, when moved in an arbitrary and/or targeted fashion, to record a point cloud representing the outer shape of a skin portion of a part of the body of the to be treated subject.

11. The method as claimed in claim 1, wherein the model body shape portion includes at least one indication of a location of a body feature, and wherein when a displaced feature or unsymmetrical features at respective sides of the skin or head is detected, adding a relocating offset to involved hair property representing values, or hair presence values.

12. The method as claimed in claim 1, comprising an act of configuring the processor to detect the deviations in the contour of the hair portion and in the level of skin at the hair portion.

13. The method as claimed in claim 1, wherein the actual body shape portion represents an actual head shape portion including an actual level of skin at the hair portion of the head.

14. The method as claimed in claim 1, wherein the model body shape portion includes at least one indication of whether hair is present at a corresponding location.

15. A system for automated hairstyle processing, the system comprising:

a memory unit arranged to store a predefined hairstyle model including hair property representing values and body shape representing values;

a sampling unit arranged to sample an actual body shape portion, of a to be treated subject; and a processing unit arranged to detect deviations from a model body shape portion of the predefined hairstyle model, wherein the actual body shape portion of the subject and the model body shape representing values include corresponding representing values for both a contour of a hair portion and a level of skin at the hair portion, and to adapt a portion of a hair property model of the predefined hairstyle model only when deviations between the actual body shape portion and the model body shape portion are detected for the portion of the hair property model that exceed a predetermined threshold such that less than all the portions of the predefined hairstyle model are adapted, to compensate for the actual body shape deviations.

16. The system as claimed in claim 15, further comprising a position determination unit that is arranged to record a point cloud representing the outer shape of a skin portion of a part of the body of the to be treated subject.

17. The system as claimed in claim 15, comprising a hand-held unit, wherein at least the sampling unit is arranged in the hand-held unit and wherein the processing unit is arranged to detect the deviations in the contour of the hair portion and in the level of skin at the hair portion.

18. The system as claimed in claim 17, comprising a blade set arranged in the hand-held unit, wherein the blade set is coupled to the processing unit to cut hair in accordance with the adapted hair property model of the predefined hairstyle model.

* * * * *